US008508413B2

(12) United States Patent
Dudley et al.

(10) Patent No.: US 8,508,413 B2
(45) Date of Patent: Aug. 13, 2013

(54) ANTENNA WITH DIELECTRIC HAVING GEOMETRIC PATTERNS

(75) Inventors: Kenneth L. Dudley, Newport News, VA (US); Holly A. Elliott, Newport News, VA (US); Robin L. Cravey, Hampton, VA (US); John W. Connell, Yorktown, VA (US); Sayata Ghose, Newport News, VA (US); Kent A. Watson, New Kent, VA (US); Joseph G. Smith, Jr., Smithfield, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 329 days.

(21) Appl. No.: 13/082,839

(22) Filed: Apr. 8, 2011

(65) Prior Publication Data

US 2011/0254739 A1 Oct. 20, 2011

Related U.S. Application Data

(60) Provisional application No. 61/324,967, filed on Apr. 16, 2010.

(51) Int. Cl.
*H01Q 1/38* (2006.01)

(52) U.S. Cl.
USPC ..... 343/700 MS

(58) Field of Classification Search
USPC ..... 343/700 MS, 787
See application file for complete search history.

(56) References Cited

U.S. PATENT DOCUMENTS

| | | | | |
|---|---|---|---|---|
| 6,943,731 | B2 * | 9/2005 | Killen et al. | 343/700 MS |
| 7,541,981 | B2 * | 6/2009 | Piskun | 343/700 MS |
| 7,704,553 | B2 | 4/2010 | Watson et al. | |
| 7,903,040 | B2 * | 3/2011 | Gevorgian et al. | 343/787 |
| 2003/0122713 | A1 * | 7/2003 | Morris et al. | 343/700 MS |
| 2004/0189527 | A1 * | 9/2004 | Killen et al. | 343/700 MS |
| 2009/0022977 | A1 | 1/2009 | Dudley et al. | |

OTHER PUBLICATIONS

Philip Felber, "Fractal Antennas," Illinois Institute of Technology, Dec. 12, 2000.

Carles Puente-Baliarda, et al., "On the Behavior of the Sierpinski Multiband Fractal Antenna", IEEE Transactions on Antennas and Propagation, Apr. 1998. pp. 517-524, vol. 46, No. 4.

M. Giona, et al., "Towards a Theory of Electrodynamics on Fractals: Representation of Fractal Curves and Integral Electromagnetic Equations in Fractal Domains," Proceedings 2002 URSI General Assembly, Aug. 17-24, 2002, Maastricht, Netherlands.

Kirk T. Mcdonald, "Small Fractal Antennas," Joseph Henry Laboratories, Princeton University, Princeton NJ, Dec. 22. 2003.

* cited by examiner

*Primary Examiner* — Seung Lee
(74) *Attorney, Agent, or Firm* — Andrea Z. Warmbier; Helen M. Galus

(57) ABSTRACT

An antenna includes a ground plane, a dielectric disposed on the ground plane, and an electrically-conductive radiator disposed on the dielectric. The dielectric includes at least one layer of a first dielectric material and a second dielectric material that collectively define a dielectric geometric pattern, which may comprise a fractal geometry. The radiator defines a radiator geometric pattern, and the dielectric geometric pattern is geometrically identical, or substantially geometrically identical, to the radiator geometric pattern.

20 Claims, 7 Drawing Sheets

ANTENNA WITH DIELECTRIC HAVING GEOMETRIC PATTERNS

CROSS-REFERENCE TO RELATED PATENT APPLICATIONS

This patent application is a nonprovisional of and claims priority to U.S. Provisional Patent Application Ser. No. 61/324,967, filed Apr. 16, 2010, the contents of which are hereby incorporated by reference in their entirety.

STATEMENT REGARDING FEDERALLY SPONSORED RESEARCH OR DEVELOPMENT

The invention was made in part by employees of the United States Government and may be manufactured and used by or for the Government of the United States of America for governmental purposes without the payment of any royalties thereon or therefor.

BACKGROUND OF THE INVENTION

1. Field of the Invention

This invention relates to antennas such as microstrip antennas. More specifically, the invention is an antenna having a dielectric having a geometric pattern.

2. Description of the Related Art

Fractal antennas utilize self-similar designed conductors to maximize antenna length or increase the perimeter of material that can receive or transit electromagnetic signals. Fractal antennas are compact, are multi-band or wideband, and are useful in cellular communication applications and microwave applications. The key aspect of these antennas is their fractal-pattern repetition of the antenna's conductor over two or more scale sizes or iterations. Fractal antenna performance can currently be controlled only via manipulation of the antenna conductors' fractal geometry.

3. Summary of the Invention

Accordingly, it is an object of the present invention to provide an antenna design offering improved performance, by having a dielectric layer comprising at least two dielectric materials arranged in a geometric pattern, including but not limited to, a fractal pattern.

Another object of the present invention is to provide a fractal antenna design having versatile performance manipulation capabilities.

In yet another embodiment of the present invention, an antenna comprises a ground plane, a dielectric member, and an electrically-conductive radiator disposed on the dielectric member. The antenna may further include a radome disposed on the radiator, where the radome includes at least one geometric pattern. The dielectric member may be disposed on the ground plane and include at least one layer of a first dielectric material and a second dielectric material. The first dielectric material and second dielectric material may be arranged to collectively define a dielectric geometric pattern, including but not limited to, a dielectric fractal pattern. The dielectric member may further include a layer of a third dielectric material adjacent to the at least one layer. The first dielectric material is characterized by a relative permittivity that is at least twice that of the second dielectric material. The first dielectric material and the second dielectric material are further characterized by a loss quantity that yields an antenna efficiency of at least approximately 70 percent. In one embodiment, the loss quantity does not exceed approximately 0.001. The radiator may define a radiator geometric pattern, including a radiator fractal pattern, and the radiator geometric or fractal pattern may be geometrically matched to the dielectric geometric or fractal patterns. The geometric pattern can extend fully or partially through the at least one layer. The radiator has a radiator impedance and the dielectric member has a dielectric impedance, and the radiator impedance may be substantially equal or equal to the dielectric impedance. The impedance of the radiator may be matched to the dielectric member.

In another embodiment of the present invention, a dielectric antenna comprises a ground plane, a dielectric layer and an electrically-conductive radiator disposed on the dielectric layer. The dielectric layer may be disposed on the ground plane and include a first dielectric material and a second dielectric material that collectively defines a dielectric geometric pattern, or fractal pattern, that extends fully through the dielectric layer. The first dielectric material is characterized by a relative permittivity that is at least twice that of the second dielectric material. The first dielectric material and the second dielectric material are further characterized by a loss quantity that yields an antenna efficiency of at least approximately 70 percent. The radiator defines a radiator geometric pattern, which may comprise a fractal pattern, and the radiator geometric pattern geometrically matches the dielectric geometric pattern (or fractal pattern). The radiator also has a radiator impedance and the dielectric layer has a dielectric impedance, and the radiator impedance is substantially equal or equal to the dielectric impedance. The antenna further comprises a radome disposed on the radiator. The loss quantity does not exceed approximately 0.001.

In a further embodiment, a microstrip antenna comprises a ground plane, a dielectric layer and an electrically-conductive radiator disposed on the dielectric layer and adapted to be exposed to a free space environment. The dielectric layer is disposed on the ground plane and includes a first layer of a first dielectric material and a second dielectric material. The first dielectric material and second dielectric material are arranged to define a dielectric geometric pattern, which may comprise a fractal geometry. The first dielectric material is characterized by a relative permittivity that is at least twice that of the second dielectric material. The first dielectric material and the second dielectric material are further characterized by a loss quantity that yields an antenna efficiency of at least approximately 70 percent. The conductor is impedance matched to the dielectric layer. The dielectric geometric pattern, or fractal pattern, can extend completely through the at least one layer. The loss quantity does not exceed approximately 0.001. The dielectric layer optionally includes a third dielectric material, wherein the first, second and third dielectric materials are arranged to define a dielectric geometric pattern, or a fractal pattern. Alternatively, the third dielectric material may comprise a second layer adjacent to the first layer, which is homogenous and may or may not comprise a geometric or fractal pattern.

DETAILED DESCRIPTION OF THE INVENTION

Figure 1:
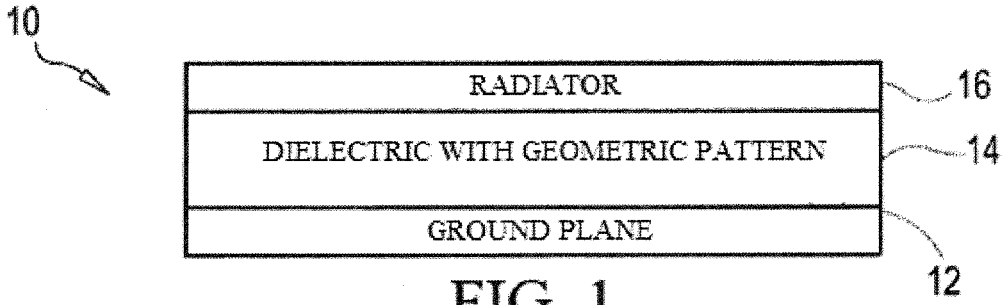
FIG. 1 is a top level schematic view of an antenna that includes a dielectric having a geometric shape in accordance with the present invention.

Referring now to the drawings and more particularly to FIG. 1, an antenna in accordance with the present invention is shown and is referenced generally by numeral 10. The antenna of the present invention may comprise variety of antenna types, including but not limited to microstrip antennas, Vivaldi antennas, patch antennas, lens antennas, Folded Inverted Conformal Antennas (FICA), Planer Inverted F-antennas (FIFA), dielectric resonator antennas (DRA), cavity antennas, cavity backed slot antennas, and all other antennas utilizing dielectrics in the substrate. Each of these antenna types generally comprises the basic structure illustrated in FIG. 1.

In general, antenna 10 includes the following three basic components: a ground plane 12, a dielectric with one or more geometric layers 14 on ground plane 12, and an antenna radiator 16 made from electrically-conductive material disposed on dielectric 14. Both ground plane 12 and radiator 16 can be configured in a variety of ways well understood in the art. The dielectric 14 may comprise one or more dielectric layers, or one or more dielectric materials. The dielectric layer may comprise a first dielectric material and a second dielectric material arranged to collectively define a geometric pattern, including but not limited to, a fractal pattern.

Figure 2:
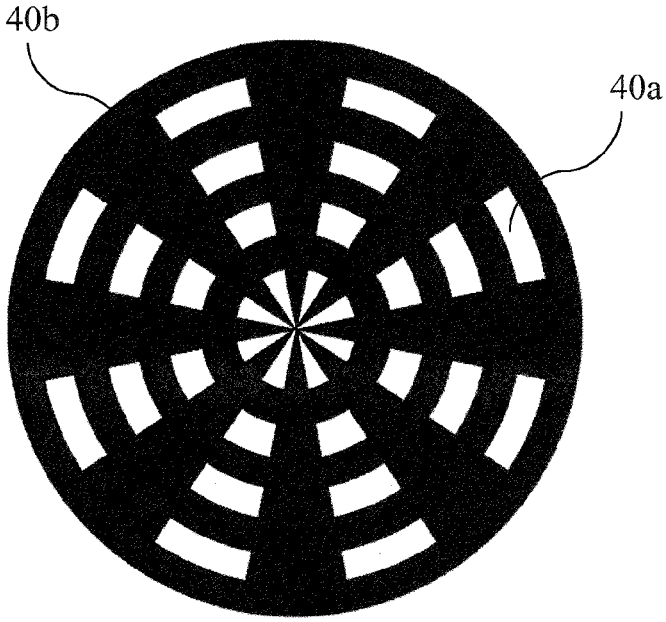
FIGS. 2-9 are plan views of exemplary dielectrics having geometric patterns that could be used in the present invention.
Figure 3:
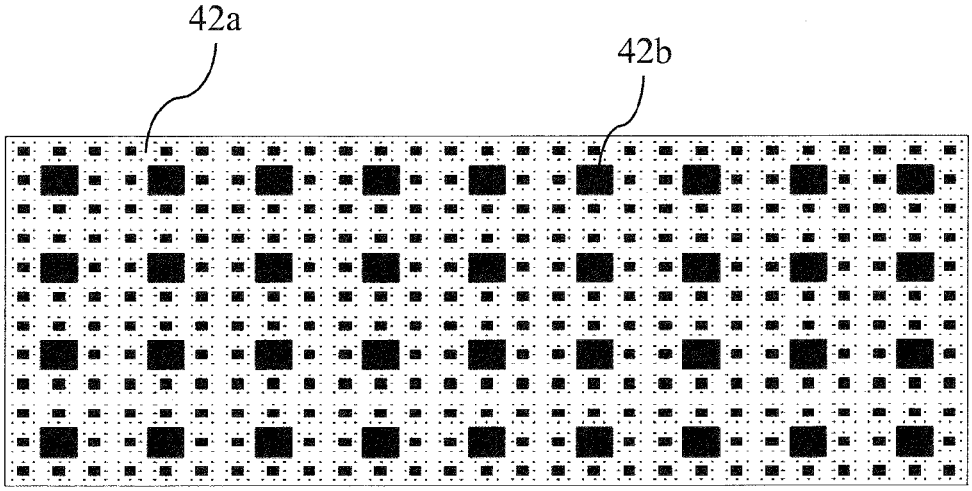
Figure 4:
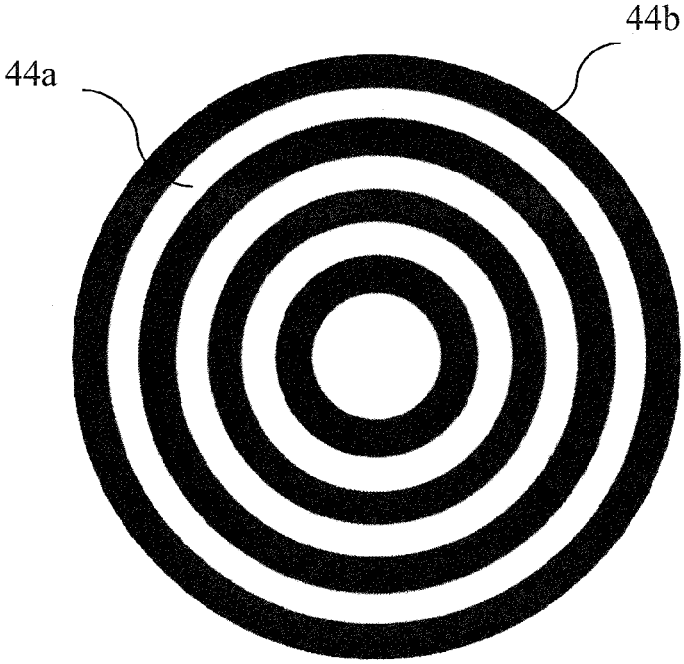
Figure 5:
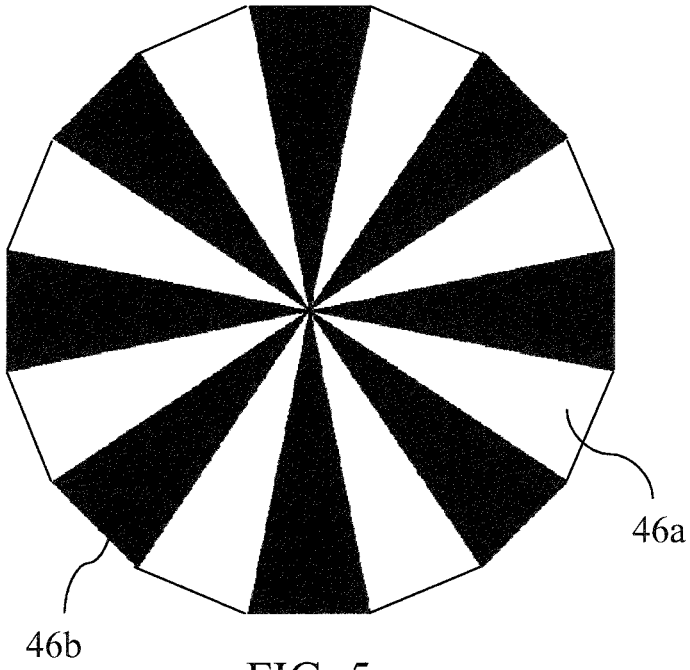
Figure 6:
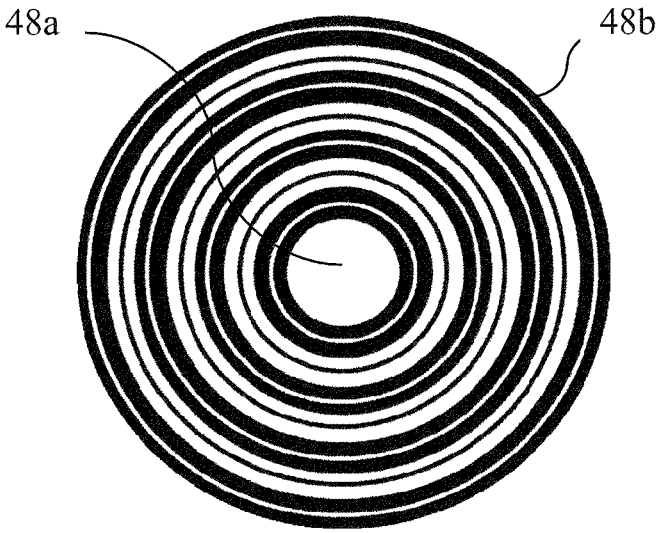
Figure 7:
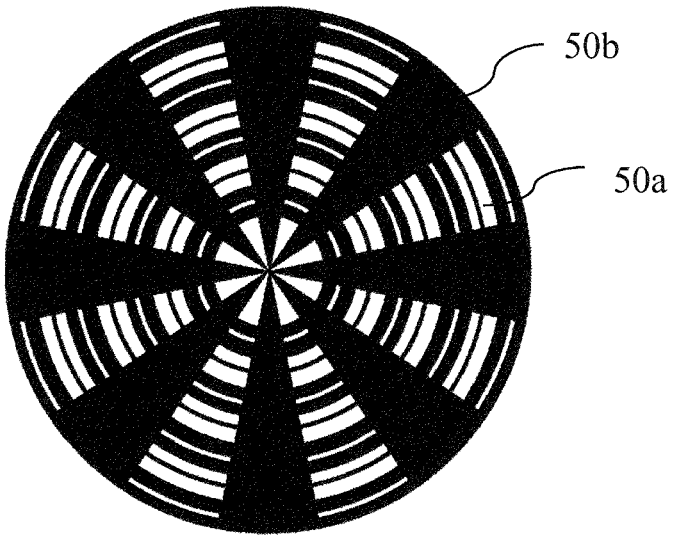
Figure 8:
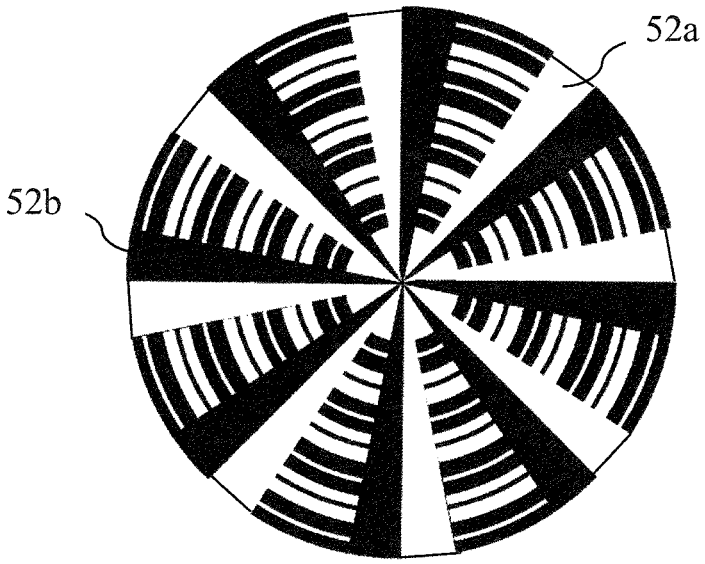
Figure 9:
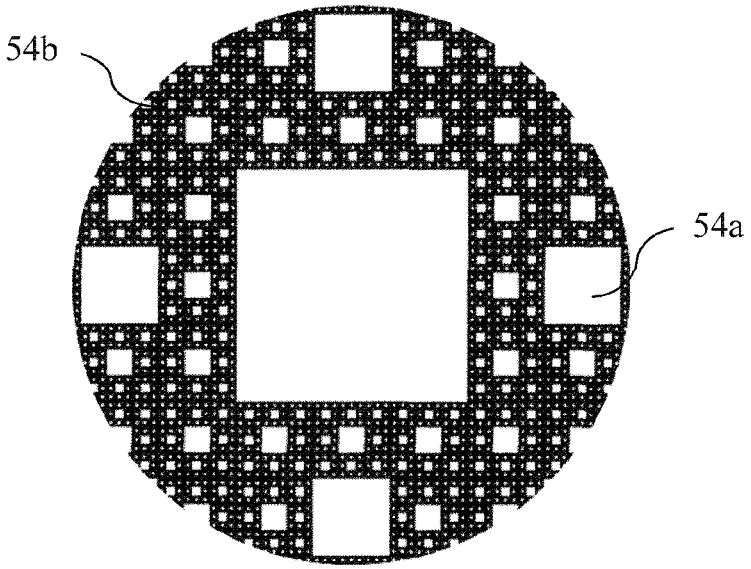

A dielectric geometric pattern of the present invention comprises at least two different dielectric materials arranged to collectively define a geometric pattern. A geometric pattern is a repetitive arrangement of geometric figures, and may include, but is not limited, a fractal pattern. A dielectric fractal pattern comprises at least two different dielectric materials arranged to collectively define a fractal geometry or pattern. A "fractal geometry" or "fractal pattern" is defined as a geometric shape having one or more fragmented parts that are reduced-size copies of the whole. These concepts are illustrated in exemplary geometries as shown in FIGS. 2-9 where the white regions define a structure formed by a first dielectric material (40*a*, 42*a*, 44*a*, 46*a*, 48*a*, 50*a*, 52*a*, 54*a*) and the black regions are formed by a second dielectric material (40*b*, 42*b*, 44*b*, 46*b*, 48*b*, 50*b*, 52*b*, 54*b*). It is to be understood that the geometric patterns illustrated is presented simply to facilitate the description of the present invention, and that the present invention does not limit the geometric pattern or fractal geometry that could be used. For example, FIGS. 2 and 7 are combinations of radial and concentric geometries, FIGS. 3 and 9 demonstrate a Sierpinski Carpet geometry, FIG. 5 is a radial geometry, and FIGS. 4 and 6 are concentric geometries. Fractal geometry dielectrics of the present invention can be defined by various fractal geometries (e.g., the Sierpinski Carpet, Koch Curve, Hilbert Curve, Peano Curve, and Cantor Dust) as well as yet-to-be-designed fractal Geometries.

For purpose of the present invention, one of the two dielectric materials must have a relative permittivity (i.e., dielectric constant) that is at least twice as great as that of the other dielectric material. The larger relative permittivity material could be used for either the geometric structure or the bounding region(s) (shown as the black regions in FIGS. 2-9) without departing from the scope of the present invention. The two dielectric materials must also be characterized by a "loss quantity" (i.e., the imaginary portion of permittivity, also referenced in the art by the term "dielectric loss factor" or "loss tangent") that will allow antenna 10 to achieve an antenna efficiency of at least approximately 70%. To achieve this, both dielectric materials are referred to as low loss dielectrics. The actual loss quantity that the two dielectric materials must satisfy will vary depending on the antenna type and efficiency requirements.

Figure 10:
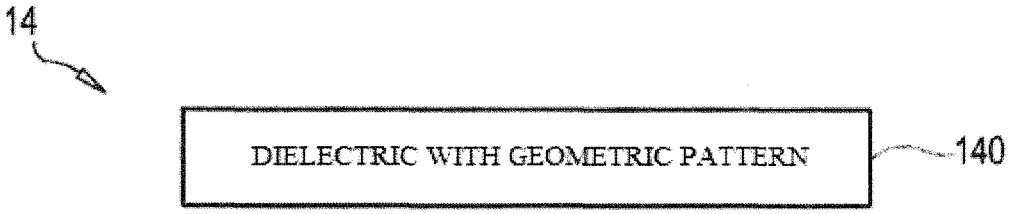
FIG. 10 is a schematic view of a single dielectric layer in accordance with the present invention.
Figure 11:
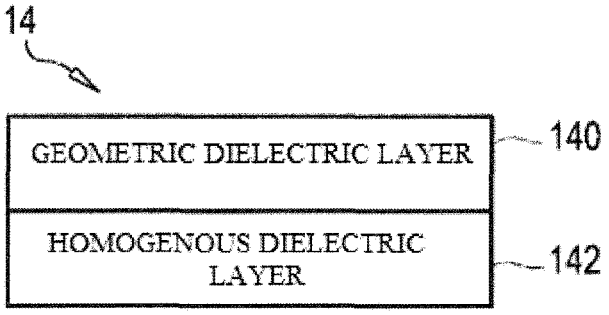
FIG. 11 is a schematic view of a multi-layer dielectric with a geometric dielectric layer and a homogenous dielectric layer in accordance with another embodiment of the present invention.
Figure 12:
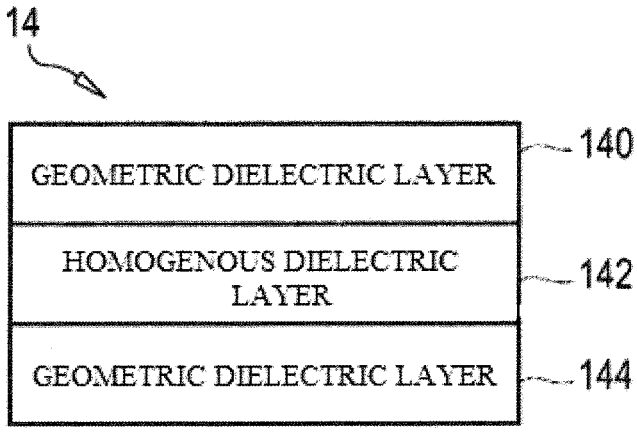
FIG. 12 is a schematic view of another multi-layer dielectric with two geometric dielectric layers sandwiching a homogenous dielectric layer in accordance with another embodiment of the present invention.

As mentioned above, dielectric 14 includes one or more layers of geometrically arranged dielectrics in accordance with the present invention. Several non-limiting examples of dielectric 14 are illustrated schematically in FIGS. 10-12. in FIG. 10, dielectric 14 is realized by a single geometric dielectric layer 140 comprised of two dielectric materials. Typically, the geometric pattern will extend fully or completely through the layer's thickness, and all planar or horizontal cross-sections of the layer may be identical. In FIG. 11, dielectric 14 is realized by a multi-layer construction that includes a geometric dielectric layer 140, and an adjacent homogenous dielectric material layer 142. Layer 142 is simply a contiguous layer of one dielectric material which can be the same as one of the materials in layer 140 or different without departing from the scope of the present invention. FIG. 12 illustrates a three-layer dielectric 14 that has two geometric dielectric layers 140 and 144 sandwiching homogenous dielectric material layer 142. Layers 140 and 144 can have the same or different geometries, including the same or different fractal geometries, and can be made from the same or different dielectric materials.

The choice of particular dielectric materials, layered structures, and/or geometries thereof, can be selected/tailored to modify antenna parameters (e.g., radiation pattern, beamforming characteristics, sidelobe control, polarization, "electromagnetic interference" (EMI) reduction, multiple frequency operation, bandwidth, impedance matching, etc.). The present invention will provide a new level of versatility that can be used to design antennas for space, aircraft, and aerospace applications to include communications, navigation (e.g., GPS, glide slope, Microwave Landing Systems (MLS), Asynchronous Direct Surveillance Broadcast (ADSB), Automatic Direction Finding (ADF), sensing (e.g., icing, weather, proximity, collision avoidance, etc.), radars, missile seeker and tracking heads, Synthetic Aperture Radars (SAR), phased arrays, all dielectric front ends, stealth antennas, radomes, countermeasures, and electronic warfare. Additional applications include cellular phone/video communication antennas, paging, radio, WiFi, GPS, Personal Electronic Devices (PEDs), automotive, security, vehicle and product tracking, smart pass and smart toll, and diversity antennas in signal cluttered environments (e.g., cities with tall buildings or high density frequency usage areas).

Figure 13:
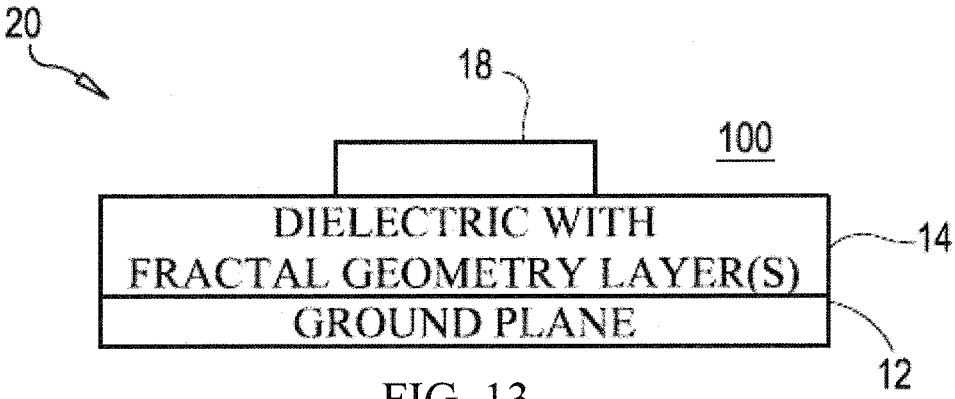
FIG. 13 is a schematic view of a microstrip antenna in accordance with an embodiment of the present invention.

Referring again to FIG. 1, antenna radiator 16 can be configured in a variety of ways without departing from the scope of the present invention. For example, antenna radiator 16 could be impedance matched to dielectric 14. Radiator 16 could also be a fractal pattern of conductive material deposited on dielectric 14. The fractal pattern of radiator 16 could be geometrically matched to dielectric 14 and/or impedance matched to dielectric 14. Radiator 16 could also be a simple conductive strip, wire, conducting run, etc., in the case of a microstrip antenna. Accordingly, FIG. 13 schematically illustrates a microstrip antenna 20 in accordance with the present invention where a simple conductor 18 is disposed on dielectric 14 and exposed to a free space environment 100. The conductor may comprise copper.

Figure 14:
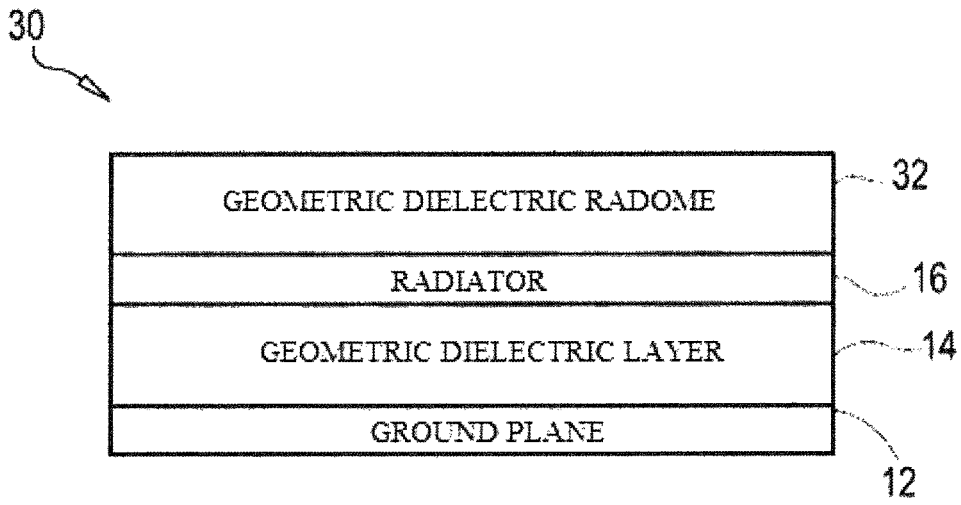
FIG. 14 is a top level schematic view of a dielectric antenna that includes a geometric dielectric layer(s) for the antenna's substrate and radome in accordance with another embodiment of the present invention.

The geometric dielectric concepts of the present invention can be extended to an antenna's radome as illustrated by antenna 30 in FIG. 14. In general, antenna 30 has a geometrically patterned dielectric radome 32 disposed on/over radiator 16. Similar to radomes, dielectric radome 32 provides physical protection and/or visual cover for antenna 30. However, dielectric radome 32 is constructed to have one or more layers of a geometric dielectric that satisfies the same criteria as layer(s) 14 in the various embodiments described above. In this way, dielectric radome 32 can also be used to, for example, shift the operation frequency of antenna 30 and/or conceal it in the electromagnetic sense.

A variety of dielectric materials satisfying the criteria for the geometric dielectric layer(s) of the present invention can be used. In terms of dielectric materials offering high relative permittivity with low loss, two recently developed materials are good candidates for use in fractal antennas of the present invention. One of these dielectric materials is described in U.S. Pat. No. 7,704,553, and the other is disclosed in U.S. Patent Application Publication No. 2009/0022977, the disclosures of each of which are incorporated by reference in their entireties. If one of these dielectric materials were used as the high dielectric material in a fractal geometry dielectric of the present invention, a variety of low loss dielectrics could be used for the other dielectric material in the geometric dielectric. For example, dielectric materials such as polytetrafluoroethylene or "PTFE" have a relative permittivity of approximately 2 with a loss factor that is also approximately 0.001. Since antennas using dielectric materials having loss factors of 0.01 or more tend to yield inefficient antennas, if both dielectric materials used in the fractal geometry dielectric layer(s) of the present invention have loss factors of approximately 0.001 or less, the resulting antenna would have increased efficiency.

The advantages of the present invention are numerous. The geometric dielectric provides a new approach to improving and/or tuning antenna performance. The approach described herein is applicable to a wide variety of antenna types to include microstrip antennas found in many of today's communication devices.

Although the invention has been described relative to a specific embodiment thereof, there are numerous variations and modifications that will be readily apparent to those skilled in the art in light of the above teachings. For example, the antenna feed structure can be adapted to the particular type of antenna being constructed as would be well understood by one of ordinary skill in the art. Accordingly, antenna feed structures are not limitations of the present invention. It is therefore to be understood that, within the scope of the appended claims, the invention may be practiced other than as specifically described.

What is claimed as new and desired to be secured by Letters Patent of the United States is:

1. An antenna comprising:

a ground plane;

a dielectric member disposed on said ground plane and including a first layer of a first dielectric material and a second dielectric material that collectively define a dielectric geometric pattern, said first dielectric material characterized by a relative permittivity that is at least twice that of said second dielectric material, said first dielectric material and said second dielectric material being further characterized by a loss quantity that yields an antenna efficiency of at least 70 percent; and an electrically-conductive radiator disposed on said dielectric member.

2. The antenna according to claim 1, wherein said radiator defines a radiator geometric pattern, and wherein said radiator geometric pattern is geometrically matched to said dielectric geometric pattern.

3. The antenna according to claim 2, wherein the radiator geometric pattern and the dielectric geometric pattern comprise a fractal pattern.

4. The antenna according to claim 1, said radiator having a radiator impedance and said dielectric member having a dielectric impedance, wherein said radiator impedance is equal to the dielectric impedance.

5. The antenna according to claim 1, wherein said radiator defines a radiator geometric pattern that is geometrically matched to said dielectric geometric pattern, and wherein said radiator impedance is matched to said dielectric member.

6. The antenna according to claim 1, wherein said dielectric geometric pattern extends fully through said first layer.

7. The antenna according to claim 1, wherein said loss quantity does not exceed 0.001.

8. The antenna according to claim 1, wherein said dielectric member further comprising a second layer having a third dielectric material, wherein said second layer is adjacent to said at least one layer.

9. The antenna according to claim 1, further comprising a radome disposed on said radiator, said radome including dielectric randome having a radome geometric pattern.

10. A dielectric antenna comprising:

a ground plane;

a dielectric layer disposed on said ground plane and including a first dielectric material and a second dielectric material that collectively define a fractal geometry that extends fully through said dielectric layer, said first dielectric material characterized by a relative permittivity that is at least twice that of said second dielectric material, said first dielectric material and said second dielectric material being further characterized by a loss quantity that yields an antenna efficiency of at least 70 percent; and an electrically-conductive radiator disposed on said dielectric layer.

11. The dielectric antenna according to claim 10, wherein said radiator defines a fractal pattern, wherein said fractal pattern geometrically matches said fractal geometry.

12. The dielectric antenna according to claim 11, said radiator having a radiator impedance and said dielectric layer having a dielectric impedance, wherein said radiator impedance is substantially equal to the dielectric impedance.

13. The dielectric antenna according to claim 12, further comprising a radome disposed on said radiator, said radome including at least one fractal geometry dielectric, and wherein said loss quantity does not exceed 0.001.

14. The dielectric antenna according to claim 11, said radiator having a radiator impedance and said dielectric layer having a dielectric impedance, wherein said radiator impedance is equal to the dielectric impedance.

15. The dielectric antenna according to claim 10, wherein said radiator defines a fractal pattern geometrically matched to said fractal geometry of said dielectric layer, and wherein said radiator impedance matched to said dielectric layer.

16. A microstrip antenna comprising:

a ground plane;

a dielectric layer disposed on said ground plane and including at least one layer of a first dielectric material and a second dielectric material that collectively define a dielectric geometric pattern, said first dielectric material characterized by a relative permittivity that is at least twice that of said second dielectric material, said first dielectric material and said second dielectric material being further characterized by a loss quantity that yields an antenna efficiency of at least 70 percent; and an electrically conductor disposed on said dielectric layer and adapted to be exposed to a free space environment.

17. The antenna according to claim 16, wherein said conductor is impedance matched to said dielectric layer.

18. The antenna according to claim 16, wherein said fractal geometry extends fully through said at least one layer.

19. The antenna according to claim 16, wherein said loss quantity does not exceed 0.001.

20. The antenna according to claim 16, wherein said dielectric layer further includes a layer of a third dielectric material adjacent to said at least one layer, and wherein said layer of a third dielectric material is homogenous.

* * * * *